US007325815B2

(12) United States Patent
Rush

(10) Patent No.: US 7,325,815 B2
(45) Date of Patent: Feb. 5, 2008

(54) ADJUSTABLE PATIENT TRANSPORT SYSTEM

(76) Inventor: Eric D. Rush, 33 Ledgewood Ave., Netcong, NJ (US) 07857

( * ) Notice: Subject to any disclaimer, the term of this patent is extended or adjusted under 35 U.S.C. 154(b) by 261 days.

(21) Appl. No.: 11/209,329

(22) Filed: Aug. 23, 2005

(65) Prior Publication Data

US 2007/0057542 A1 Mar. 15, 2007

(51) Int. Cl.
*A61G 13/10* (2006.01)

(52) U.S. Cl. ..... 280/47.25; 280/644; 280/47.18; 5/627; 297/31; 297/221

(58) Field of Classification Search ..... 280/644, 280/47.18, 47.25; 5/627, 626, 625; 297/283.4, 297/221, 31, 452.13, 452.56, 230.11, 230.14
See application file for complete search history.

(56) References Cited

U.S. PATENT DOCUMENTS

| | | | | |
|---|---|---|---|---|
| 567,524 | A | 9/1896 | Wagner et al. | |
| 1,985,222 | A * | 12/1934 | Menhall | 297/223 |
| 2,362,721 | A | 11/1944 | Reynolds | 5/626 |
| 2,467,468 | A * | 4/1949 | Duby et al. | 297/219.1 |
| 2,536,592 | A * | 1/1951 | Wiederhold et al. | 297/221 |
| 2,699,557 | A | 1/1955 | Gravatt | 5/626 |
| 2,858,879 | A | 11/1958 | Branson | 297/19 |
| 3,038,174 | A | 6/1962 | Brown et al. | 5/611 |
| 3,088,770 | A | 5/1963 | Weil et al. | 296/20 |
| 3,122,758 | A | 3/1964 | Ferneau | 5/626 |
| 3,137,511 | A | 6/1964 | Weil et al. | 280/5.24 |
| 3,289,219 | A | 12/1966 | Ferneau et al. | 5/626 |
| 4,136,888 | A | 1/1979 | Bowie, Jr. et al. | 280/5.22 |
| 4,320,922 | A * | 3/1982 | Meritis | 297/220 |
| 4,323,260 | A * | 4/1982 | Suchy | 280/47.25 |
| 4,473,234 | A | 9/1984 | Egen | 280/5.22 |
| 4,600,238 | A * | 7/1986 | Goodford | 297/219.1 |
| 4,688,279 | A | 8/1987 | Vance | 5/626 |
| 4,790,592 | A * | 12/1988 | Busso et al. | 297/184.11 |
| 5,246,265 | A * | 9/1993 | Nagan et al. | 297/54 |
| 5,330,251 | A * | 7/1994 | McGuire | 297/229 |
| 5,338,048 | A | 8/1994 | Medina | 280/5.22 |
| 5,509,159 | A | 4/1996 | Du-Bois | 5/627 |
| 6,079,777 | A * | 6/2000 | Simmons et al. | 297/217.1 |
| 6,152,401 | A * | 11/2000 | Green | 244/118.6 |

(Continued)

FOREIGN PATENT DOCUMENTS

| | | |
|---|---|---|
| GB | 2234442 | 2/1991 |

*Primary Examiner*—Jeff Restifo
(74) *Attorney, Agent, or Firm*—Ernest D. Buff & Associates, LLC; Ernest D. Buff; Margaret A. LaCroix

(57) ABSTRACT

An adjustable patient transport system transports a patient in a comfortable, safe manner by allowing the operator to adjust the head support portion of the apparatus to suit the patient's height. The adjustable patient transport system broadly comprises a patient transport chair having an adjustable back comprising a seat portion, back portion, head support portion, rear leg portion, front leg portion, and material roller system. The back portion comprises an outer frame having a hollow insert and a cloth backing adapted to support a patient's back; the head support portion comprises an inner frame adapted to be received in the hollow insert of the outer frame. The head support portion further comprises a horizontal cross bar having adjustable support material fixedly attached thereto connecting to the material roller system. The adjustable patient transport system can be folded for convenient storage.

15 Claims, 3 Drawing Sheets

U.S. PATENT DOCUMENTS 6,381,781 B1 5/2002 Bourgraf et al. ..... 5/618
6,382,720 B1 * 5/2002 Franklin et al. ..... 297/228.13
6,561,524 B1 5/2003 Medina ..... 280/5.22
6,637,815 B1 * 10/2003 Louque et al. ..... 297/184.11
6,648,343 B2 11/2003 Way et al. ..... 280/5.22
6,659,551 B1 * 12/2003 Arenas ..... 297/229
6,789,809 B2 * 9/2004 Lin ..... 280/47.25
7,175,231 B2 * 2/2007 Gallo ..... 297/220
7,210,738 B1 * 5/2007 Mahaffy ..... 297/184.1
2004/0206555 A1 10/2004 Schneider ..... 180/9.32

* cited by examiner

ADJUSTABLE PATIENT TRANSPORT SYSTEM

BACKGROUND OF THE INVENTION

1. Field of the Invention

The invention relates to an adjustable transport system for ambulatory patients and the like; and more specifically to a patient transport system that can be adjusted to accommodate an array of patient heights, so that the patient's back and neck are comfortably supported during transport, and which can be folded for storage.

2. Description of the Prior Art

Proper support of a patient's neck and back is extremely critical when the patient is being transported in a chair or stretcher unit, especially when the chair or stretcher is traversing stairs and rough terrain that has a tendency to increase jostling of the patient. In particular, the patient's neck and back require stability, especially in cases where patient transport is effectuated over steps or other terrain that call for a change in height, cracks in the pavement, and other rough features likely to adversely impact the patient's body. Many of the patient transport chairs heretofore disclosed and utilized do not provide proper support for the back and neck of patients of varying sizes. As a result, taller patients tend to be vulnerable to discomfort, and even injury, as their heads, necks, and upper back are not adequately supported. In addition to lacking back height adjustment capabilities, many of the patient transport systems heretofore disclosed and utilized cannot be readily folded for quick, convenient storage while also providing a lightweight apparatus that can be carried effortlessly.

Even still, many of the patient transport chairs heretofore disclosed and utilized do not provide efficient mobility during traverse of stairways and rough terrain, as the wheels of the chair are small and difficult to maneuver. However, if the wheels were omni-directional, larger in size, and composed of rubber, such rough terrain would be readily traversed with ease. Unfortunately, such omnidirectional, large, rubber wheels have heretofore not been disclosed for use with patient transport systems. Moreover, handles heretofore provided by patient transport devices are located in inconvenient positions and tend to cause back strain when an operator is lifting the transport device.

Chairs heretofore disclosed and utilized for transporting patients down stairs fail to provide the ability to adjust the back and neck support of the patient, further accentuating the patient's discomfort, or even compounding the patient's injury. U.S. Pat. No. 4,136,888 to Bowie, Jr. et al. discloses a foldable chair device adapted to facilitate the transportation of persons down stairways, providing treaded belt assemblies to assist in the transport of the chair. U.S. Pat. No. 4,473,234 to Egen discloses a carriage appointed for descending stairs with the assistance of an operator having a chair formation and includes dual belts extending along a rigid longitudinal frame with two pulleys mounted at the opposite ends thereof to facilitate staircase descent. U.S. Pat. No. 6,648,343 to Way, et al. discloses a stair chair comprising a seat assembly mounted to a main frame and configured to pivot about a first pivot axis so that the chair can be folded for storage. U.S. Patent Application Publication No. 2004/0206555 to Schneider discloses an improved stair chair stretcher assembly whereby an oval belt for facilitating traversing stairs is attached to the bottom rear portion of an ambulance stretcher. None of these disclosures provide an adjustable patient transport system that provides a chair having an adjustable back frame and adjustable material support system that allows the back portion of a chair to be adjusted to comfortably and safely support a patient's back, neck, and head.

Other transport devices are stretcher conformations and cannot be converted into chairs for transporting a patient. Both U.S. Pat. No. 3,088,770 to Weil, et al. and U.S. Pat. No. 5,509,159 to Du-Bois disclose carts or undercarriage devices for transporting a stretcher having collapsible legs. However, neither of these devices can be arranged in a chair conformation. Furthermore, neither of these devices provide for adjustment of the back portion of the apparatus.

Where chair-to-stretcher conformations are disclosed in the transport devices heretofore disclosed and utilized, these devices lack means for adjusting the back and neck support of the device, with the result that the patient is not adequately supported. U.S. Pat. No. 567,524 to Wagner, et al. discloses a folding stretcher that can be configured to a chair or a stretcher arrangement. U.S. Pat. No. 2,362,721 to Reynolds discloses a convertible and collapsible lifter adapted to be adjusted in one or more positions to support and transport a convalescent patient. U.S. Pat. No. 2,699,557 to Gravatt discloses a stretcher that can be converted from a reclining position to a chair position while the patient is resting. U.S. Pat. No. 2,858,879 to Branson discloses a device having a unshaped telescoping section in one end so that the device can form a collapsible cot, chair or stretcher. U.S. Pat. No. 3,038,174 to Brown, et al. discloses a paraplegic hospital chair that can be converted to a stretcher having means to adjust the back to suitable incline positions along the horizontal plane. U.S. Pat. No. 3,122,758 to Femeau discloses a combined stretcher and stair chair wherein a back support frame section has a pair of spaced tubular frame members adapted to extend and retract so that the chair to stretcher (or stretcher to chair) conformations can be achieved. None of these disclosures provide an adjustable patient transport system having an adjustable back frame and adjustable material support system that allows the back portion of a chair to be adjusted.

Numerous other chair-to-stretcher apparatuses also fail to provide for back height adjustment. U.S. Pat. No. 3,137,511 to Weil, et al. discloses a stretcher chair comprised of a plurality of pivoted panels which may be configured to a stretcher or chair conformation optionally supported on inclined skids, and providing for adjustment of the angle of inclination of the backrest. U.S. Pat. No. 3,289,219 to Femeau, et al. discloses an ambulance cart that can be converted into a rolling chair by way of releasable leg bracing means for releasing pivotally mounted legs. U.S. Pat. No. 4,688,279 to Vance discloses a combination stretcher and stair chair comprising a main frame pivotally connected to a torso section, a leg rest section, a set of diagonal braces, and means for releasabley locking the sections in both the collapsed and elevated positions. U.S. Pat. No. 6,381,781 to Bourgraf, et al. discloses a combination ambulance cot and chair broadly comprising a support frame having a roller base, and a wheeled back segment and operating so that the cot is elevated to permit rolling of the reclined cot into the back of an ambulance. Foreign Patent No. GB 2,234,442A to Lee, et al. discloses an emergency stretcher comprising a framework having two end sections and a middle section jointed by pivoting means so that the stretcher can be configured to a chair conformation. None of these disclosures provides an adjustable patient transport system that comprises a chair having an adjustable back frame and an adjustable material support system that allows the back portion of a chair to be adjusted.

Other transport devices heretofore disclosed and utilized provide for head restraints, which can act to provide stabilization to the head, but do not provide support for the upper back, neck, and head, and are not effectuated through use of an adjustable back portion. For example, U.S. Pat. No. 5,338,048 to Medina discloses a collapsible wheelchair for easy storage wherein the chair includes a headband attached to a back section of the chair. The headband slides along the back section, and is connected around the patient's head to stabilize and restrain the head from jostling about. Also, U.S. Pat. No. 6,561,524 Medina discloses a collapsible chair for transporting people up and down stairs providing a head restraint that can slide up and down an upper frame section. Although both these patent provide a head restraint, neither provide an adjustable back portion having an adjustable head support portion interstitially connected to adjustable material fed from a material roller system. The head restraint merely stabilizes the head, but it does not provide support for the upper back and the neck region of the patient.

Significantly, none of the adjustable patient transport systems heretofore disclosed and utilized provides a system that has an adjustable head support portion interstitially connected to adjustable support material that is fed from a material roller system. None of the stair chairs heretofore disclosed and utilized provides an adjustable patient transport system that provides a chair having an adjustable head support portion interstitially connected to adjustable support material that can readily be converted into a stretcher. In addition to lacking these crucial elements, many of the patient transport systems heretofore disclosed and utilized cannot be readily folded for compact storage and are not lightweight apparatuses that can be carried effortlessly.

For the foregoing reasons, there exists a need in the art for an adjustable patient transport system having a back support and head support portion capable of being adjusted to comfortably and safely transport a patient. Specifically, there exists a need in the art for an adjustable patient transport system having a head support potion being fixedly attached to adjustable support material that is in turn fed from a material roller system. Additionally, there is a need in the art for an adjustable patient transport system that provide optimal comfort to the operator, by providing large rubber omni-directional wheels that glide over rough terrain and by providing carrying handles that are ergonomically functional so that the operator can lift the device without sustaining back injury. In addition, there is a need in the art for an adjustable patient transport system that can be collapsed or folded so that the device can be housed in small spaces, such as is found in the common ambulance. For the forgoing reasons there exists a need in the art for an adjustable patient transport system that can be adjusted to accommodate a array of patients' heights so that the patient's back and neck are comfortably and safely supported during transport.

SUMMARY OF THE INVENTION

The present invention provides an adjustable patient transport system that promotes the proper support of a patient's neck and back as the patient is being transported, and also provides the convenience of a ready, foldable device for compact storage. A chair has an adjustable head portion interstitially connected to adjustable support material that is in turn fed from a material roller system. As the head portion is adjusted upward in height, the adjustable support material is also adjusted as the material is released from the material roller system. In turn, when the head portion is lowered in height, the adjustable support material is retracted back onto the material roller system, avoiding any bunching or obstructions which can be caused by loose lying material. The present transport system also provides the ability to readily fold or collapse for storage. Advantageously, the present transport system not only provides the ability to adequately support a patient's head, neck, and upper back, but also provides the ability to readily fold or collapse the chair when not being utilized, so that the collapsed or folded device can be readily housed in small spaces, such as on an ambulance.

More specifically, in one embodiment, the invention provides an adjustable patient transport system for transporting a patient in a comfortable safe manner by allowing the operator to adjust the head support portion of the apparatus to suit the particular patient's height. The adjustable patient transport system broadly comprises a patient transport chair having a seat portion, back portion, head support portion, rear leg portion, front leg portion, and material roller system. The system may further comprise a patient transport chair having a seat portion, back portion, head support portion, rear leg portion, front leg portion, and material roller system with the head support portion being adjustable in height and located within and extending from the back portion. The head support portion further comprises a horizontal cross bar having adjustable support material fixedly attached thereto. The material roller system comprises a material roll bar and an inner roll rod with the adjustable support material being rolled-up and extending from the material roll bar. The material roll bar is adapted to be activated to a material feed position, material retraction position, or a locking position.

In another embodiment, the adjustable patient transport system comprises a patient transport chair having a seat portion, back portion, head support portion, rear leg portion, front leg portion, and material roller system. The back portion comprises an outer frame having a hollow insert and a cloth backing adapted to support a patient's back. The outer frame comprises an outer aperture for receiving a locking pin. The head support portion comprises an inner frame adapted to be received in the hollow insert of the outer frame of the back support portion. The inner frame has a plurality of apertures adapted for receiving the locking pin. The head support portion further comprises a horizontal cross bar having adjustable support material fixedly attached thereto. Additionally, the material roller system comprises a material roll bar, an inner roll rod, and a rolling pin system. The rolling pin system is adapted to activate the inner roll rod and material roll bar in a material feed position, material retraction position, or a locking position. In addition the adjustable patient transport system readily folds in a compact manner for storage.

Optionally, the material feed position of the rolling pin system is activated when the locking pin is released from the inner aperture of the inner frame and the inner frame is adjusted in an upward direction. The material retraction position is activated when the head support portion is quickly pulled once in a short upward motion. The locking position is activated when the head support portion is quickly pulled again in a short upward motion. The locking pin is then inserted into the inner and outer apertures of the inner and outer frames.

The front leg portion comprises two parallel bars and a horizontal bottom bar extending there between. The front leg portion further comprises dual rotating carrying handles pivotally connected to each of the parallel bars of the front legs. The carrying handles each have a curved notch for receiving the bottom bar of the front leg portion when the rotating carrying handles are rotated in an extended position.

Optionally, the head support portion further comprises a second cross bar having handles fixed thereto. In this embodiment, the head support portion may further comprise a second cross bar. The second cross bar may in turn be appointed with handles.

The rear leg portion may further comprise dual omni-directional wheels composed of rubber. These dual omni-directional wheels have a height ranging from 7 cm to 18 cm (2.8 to 7.09 inches), and a width ranging from 5 cm to 15.2 cm (2 to 6 inches). Alternatively, the dual omni-directional wheels comprise an inner air tube surrounded by an outer rubber tire portion. The front leg portion may further comprise dual omni-directional wheels composed of rubber.

Optionally, the seat portion and the back portion are pivotally connected by a first hinge. The back portion is adapted to rotate about the first hinge in a 180 degree pivot; at least 90 degrees in the forward direction, and at least 90 degrees in the backward direction. When the back portion is rotated in the forward direction, the back portion rests horizontally on-top of the seat portion, forming the fold-up configuration. The front leg portion and the rear leg portion also include pivot points to that both portions can be rotated to fold under the seat portion, and thus fold up for storage of the adjustable patient transport system.

Optionally, the front leg portion is pivotally connected by a second hinge to the seat portion. The front leg portion is adapted to rotate about the second hinge so that the front leg portion forms a flat configuration horizontal with the seat portion. Also, the rear leg portion is pivotally connected to the seat portion by way of a rear leg hinge. The rear leg portion is adapted to rotate about the rear leg hinge so that the rear leg portion folds under the seat portion. The adjustable support material may have a width of at least 15 cm (6 inches).

Alternatively, the front leg portion is pivotally connected by a second hinge to the seat portion. The front leg portion is adapted to rotate about the second hinge so that the front leg portion forms a flat configuration horizontal with the seat portion. The rear leg portion has height adjustment means and omni-directional wheels, and the rear leg portion is adapted to rotate about the rear leg hinge so that the rear leg portion folds under the seat portion.

BRIEF DESCRIPTION OF THE DRAWINGS

The invention will be more fully understood and further advantages will become apparent when reference is had to the following detailed description, appended claims, and accompanying drawings, in which:

DESCRIPTION OF THE PREFERRED EMBODIMENTS

The arrangement provides for an Adjustable Patient Transport System adapted for safely and comfortably transporting a patient. One embodiment of the Adjustable Patient Transport System provides a patient transport chair comprising a seat portion, back portion, head support portion, rear leg portion, front leg portion, and material roller system. The head support portion comprises an inner frame with apertures, while the back portion has an outer frame with a hollow insert construction and an outer aperture adapted for receiving the head support portion's inner frame and a locking pin. The material roller system provides adjustable material feed, as material from the roller traverses up through the back portion of the chair and fixedly extends to the head support portion. These elements are arranged to form an adjustable patient transport system yielding support for a patient's head and neck while the patient is being transported. As a result, the risk to the patient is mitigated and the patient's comfort is maximized.

Figure 1:
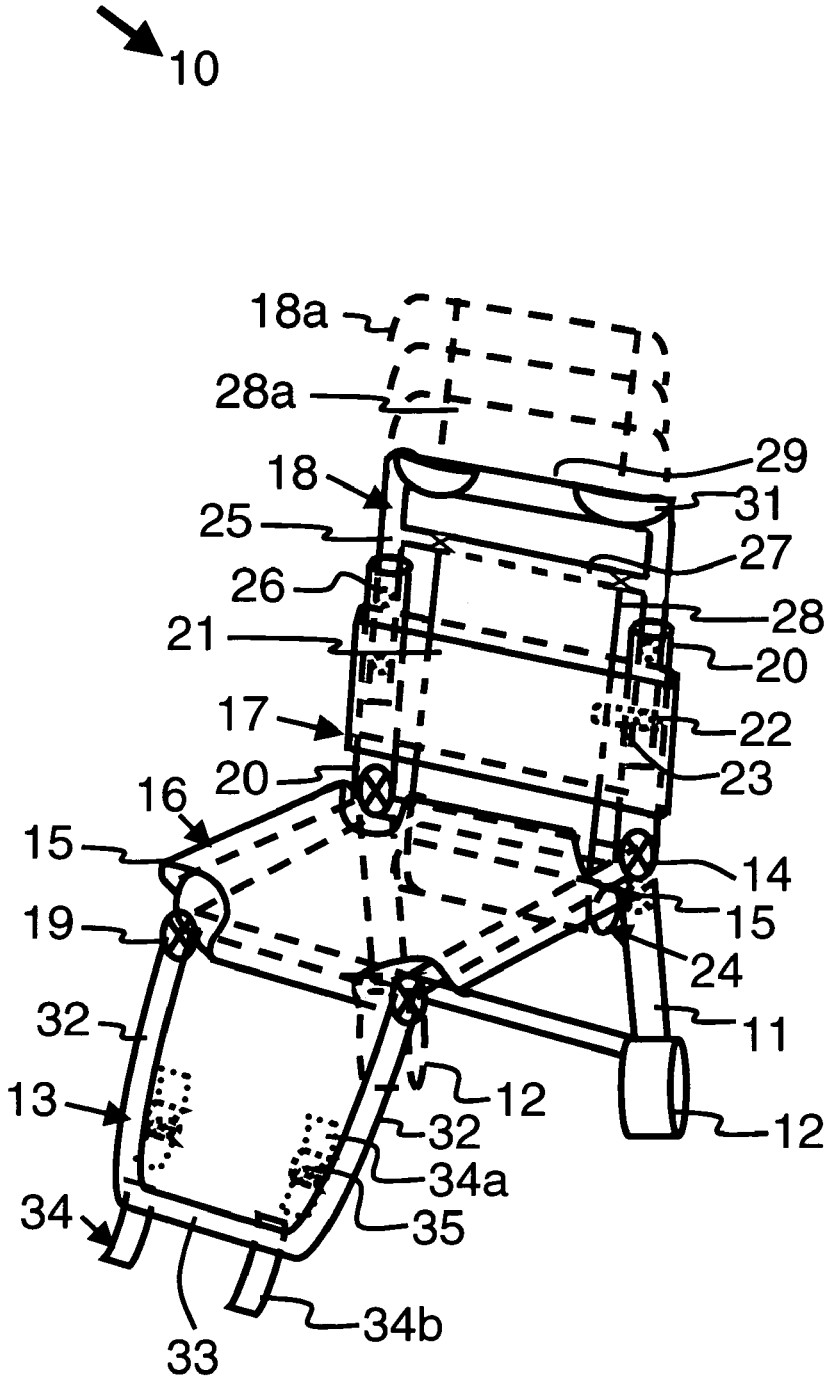
FIG. 1 is a schematic view of the Adjustable Patient Transport System in the chair configuration.

The Adjustable Patient Transport System is shown in FIG. 1 in the chair configuration, generally at 10. The Adjustable Patient Transport System shown herein comprises a seat portion 16, back portion 17, head support portion 18, rear leg portion 11, front leg portion 13, and material roller system 24. The back portion 17 comprises an outer frame 20 having a hollow insert construction. Outer frame 20 preferably has a cylinder or tube like construction. The back portion 17 is provided with a cloth backing 21 adapted to support a patient's back. This cloth backing 21 is not adjustable, but is of a fixed width and height. Outer frame 20 has at least one outer aperture 22 adapted to receive a locking pin 23. Head support portion 18 comprises an inner frame 25 having an inverted u-shape configuration. Inner frame 25 is adapted to be received in the hollow insert of outer frame 20. Inner frame 25 preferably has a cylinder or tube like construction. The inner frame 25 has a plurality of apertures 26 located at designated heights along the inner frame 25. Apertures 26 are adapted for receiving locking pin 23.

When a patient is seated within chair 10, locking pin 23 is pulled by an operator, releasing the locking pin 23 from aperture 26 and outer aperture 22. Directional force is applied by the operator in an upward or downward direction, depending on the given patient's height. As directional force is applied, inner frame 25 readily adjusts in the upward or downward direction. As inner frame 25 is being adjusted it traverses the hollow insert of outer frame 20. When the desired height of the head support portion 18 is reached, locking pin 23 is inserted by the operator into outer aperture 22 of outer frame 20 and traverses within aperture 26 of inner frame 25. Locking pin 23 may be located on either side of outer frame 20 and inner frame 21. Alternatively, there may be a locking pin 23 located on both sides of the outer frame 20 and inner frame 21, so that there are two separate locking pins 23 operating contemporaneously with one another.

Head support portion 18 further comprises a horizontal cross bar 27. Horizontal cross bar 27 may be provided with handles (not shown). Alternatively, head support portion 18 also includes a second cross bar 29, which in turn includes handles 31. The horizontal cross bar 27 has adjustable support material 28 fixedly attached thereto. Head support portion 18 via the adjustment of inner frame 25, can be adjusted to various heights as indicated by way of phantom heights 18*a*. As head support portion 18 is adjusted in height, adjustable support material 28 is contemporaneously adjusted in height, as also indicated by way of phantom heights 28*a* in conjunction with 18*a*. Adjustable support material 28 has a width of at least 15 cm (6 inches) in order to accommodate the back width of an average adult person.

The adjustable support material 28 is fed from material roller system 24 when material roller system 24 is activated. Material roller system 24 is activated when locking pin 23 is removed from outer aperture 22 and inner aperture 26 and directional force (upward or downward) is applied. Material roller system 24 is located behind seat portion 16 and is adjacent to back portion 17. Adjustable support material 28 traverses behind cloth backing 21 of outer frame 20 as the adjustable support material 28 is fed from material roller system 24.

Material roller system 24 houses rolled up portions of adjustable support material 28. Rolling and locking positions are provided by the material roller system 24, much like conventional window blind structures. The rolling position of the material roller system 24 is activated when the locking pin 23 is released from the inner and outer apertures, 26 and 22, respectively, of the inner and outer frame, 25 and 20, respectively, and directional force is applied to head support portion 18. The rolling position of the material roller system 24 is de-activated when head support portion 18 is adjusted to the desired height and locking pin 23 is inserted within outer aperture 22 and into inner aperture 26 of the outer and inner and outer frames, 20 and 25, respectively. Second cross bar 29 is optional, and includes handles 31.

Seat portion 16 is provided with seating material 15. Front leg portion 13 is located adjacent to seat portion 16 and provides support for the patient's legs and feet. Front leg portion 13 comprises two parallel bars 32 and a horizontal bottom bar 33 extending there between. Dual rotating carrying handles 34 are pivotally connected to each of the parallel bars 32 at handle pivot 35. Each of the dual rotating carrying handles 34 have a curved notch for receiving bottom bar 33 of front leg portion 13 when the rotating carrying handles 34 are rotated in an extended position 34*b*. Rotating carrying handles 34 lay flush against parallel bars 32 when in the folded position, as shown by way of phantom carrying handles 34*a*.

Figure 2:
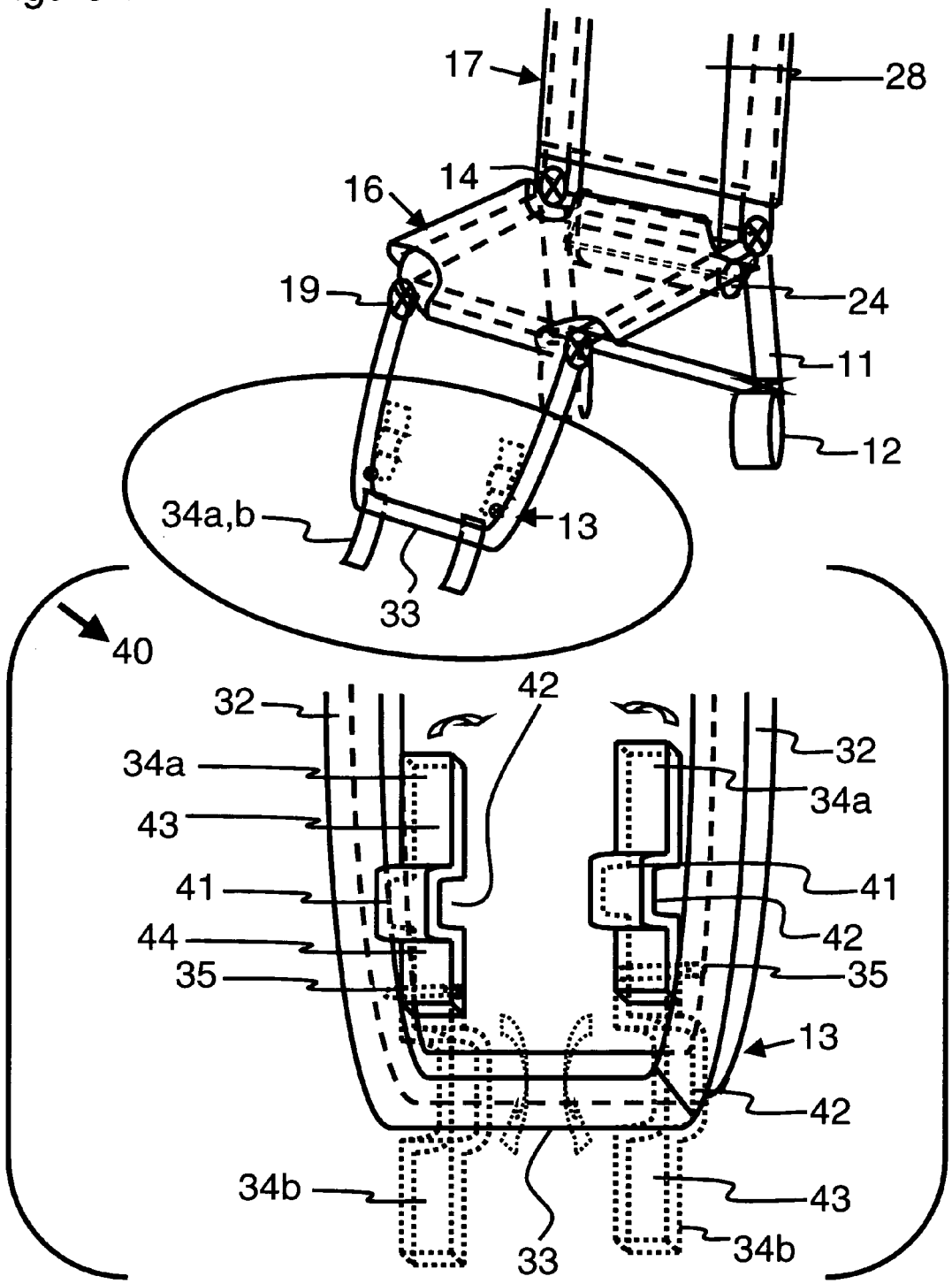
FIG. 2 is a schematic view of dual rotating carrying handles pivotally connected to the front leg portion of the Adjustable Patient Transport System.

The rotating carrying handles 34 shown in FIG. 1 are illustrated in FIG. 2, shown generally at 40. Front leg portion 13 comprises two parallel bars 32 and a horizontal bottom bar 33 extending there between. Dual rotating carrying handles 34 are shown in the flush configuration 34*a*, while the extended configuration 34*b* is shown by way of phantom lines. Rotating carrying handles 34 are pivotally connected to each of the parallel bars 32 at handle pivot pin 35. Each of the dual rotating carrying handles 34 have a curved notch 41 having a notch aperture 42 for receiving bottom bar 33 of front leg portion 13 when the rotating carrying handles 34 are rotated in the extended position 34*b*. As carrying handles 34 rotate from the flush position 34*a* to the extended position 34*b*, notch aperture 42 receives bottom bar 33 while curved notch 41 provides support and greater leverage to the operator attempting to carry the chair 10 with the patient therein.

As depicted in FIG. 2, rotating carrying handles 34 lay flush against parallel bars 32 when in the folded position, as shown by way of phantom carrying handles 34*a*. Carrying handles 34 comprise hand region 43, curved notch 41 forming notch aperture 42, and pivot region 44. Pivot region 44 has a pivot aperture fixedly housing handle pivot pin 35. As carrying handles 34 are rotated about handle pivot pin 35, the carrying handles 34 rotate from the flush position 34*a*, down under bottom bar 33, to rest in the extended configuration 34*b*. The flush arrangement of the carrying handles 34 in folded position 34*a* provides comfort and safety to the patient by mitigating contact with the patient's calf, ankle and foot areas which could otherwise cause harm or discomfort. Notch 41 and notch aperture 42 minimize the lifting force required by the operator and mitigates back injuries to the operator while carrying the chair 10 with a patient therein.

Returning to FIG. 1, optionally, rear leg portion 11 is provided with dual wheels 12. Wheels 12 are omni-directional and can rotate 360 degrees. Wheels 12 are composed of rubber and are large in size, having a height ranging from 7 cm to 18 cm (2.8 to 7.09 inches in height), preferably being 4 inches in height. Wheels 12 have a width ranging from 5 cm to 15.2 cm (2 to 6 inches in width). Front leg portion 13 is not provided with wheels. Optionally, front leg portion 13 also has omni-directional wheels. The omni-directional nature of wheels 12 provide the ability for the operator to turn corners readily and to navigate through cumbersome spaces or terrain. The wheels 12 are composed of rubber and optionally have an inner air tube as a traditional tire would have. As a result, the wheels 12 provide a gliding movement and absorb shock caused by rough terrain, bumps, or the like. The height and width of the wheels 12 provide a greater surface area of contact between the wheel 12 and the ground, and thereby mitigate jostling of the patient, while also providing the operator with greater comfort and control while pushing and operating chair 10.

Seat portion 16 and back portion 17 are pivotally connected by a back portion hinge set 14. The back portion 17 is adapted to rotate about hinge set 14 in a 180 degree pivot; at least 90 degrees in the forward direction, and at least 90 degrees in the backward direction. When the back portion 17 is rotated in the forward direction about hinge set 14, the back portion 17 rests horizontally on-top of seat portion 16, forming the fold-up configuration. In turn, a leg portion hinge set 19 pivotally connects front leg portion 13 to seat portion 16. Front leg portion 13 is adapted to rotate in a 180 degree pivot about leg portion hinge set 19 so that front leg portion 13 can rotate in the horizontal plane with seat portion 16; and rotates horizontally under seat portion 16 when the fold-up confirmation is desired. Additionally, rear leg portion 11 is pivotally connected to seat portion 16 by way of a rear leg hinge 15 adapted to rotate in at least a 90 degree pivot so that rear leg portion 11 can rotate horizontally under seat portion 16 when the fold-up confirmation is desired.

Figure 3:
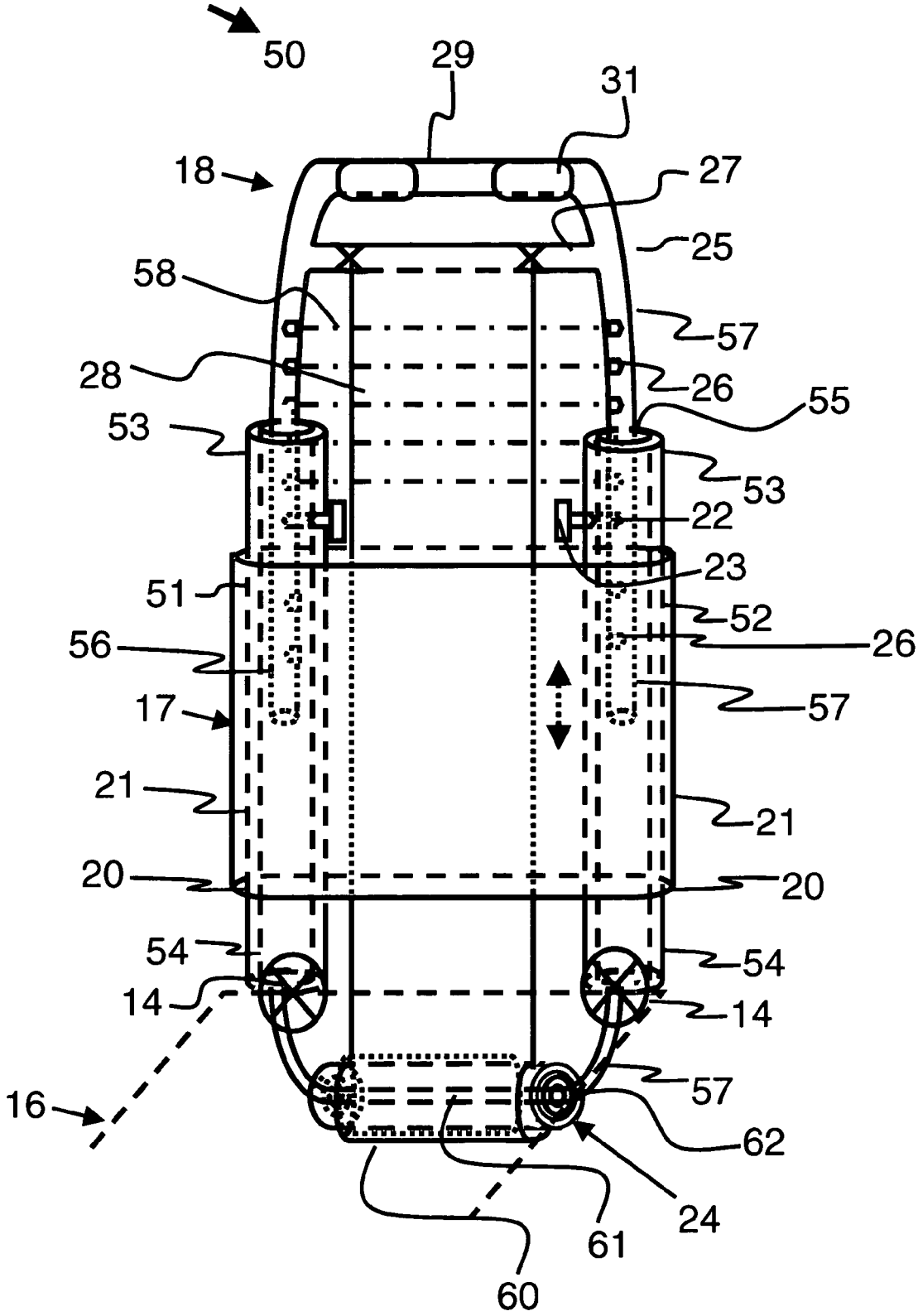
FIG. 3 is a schematic view of the back portion and material roller system of the Adjustable Patient Transport System.

A schematic view of the back portion 17 and material roller system 24 of The Adjustable Patient Transport System is shown in FIG. 3 generally at 50. Back portion 17 comprises an outer frame 20 having a left and right post 51 and 52. The left and right posts 51 and 52 of outer frame 20 are surrounded by cloth backing 21 adapted to support a patient's back. This cloth backing 21 is not adjustable, but is of a fixed width and height. The left and right posts 51 and 52 have a top portion 53 and bottom portion 54. Top portion 53 of left and right posts, 51 and 52, respectively, comprises an outer post insert aperture 55 adapted to receive left and right inner post portion 56 and 57, respectively, of inner frame 25 of head support portion 18. Bottom portion 54 is pivotally attached to seat portion 16 by way of back portion hinge 14. Bottom portion 54 is also attached to material roller system 24 by way of attachment bar 57. Attachment bar 57 is located under back portion 17 and beneath and adjacent to seat portion 16.

Each top portion 53 of left and right posts 51 and 52 of outer frame 20 further comprises at least one outer aperture 22 adapted to receive a locking pin 23. Alternatively, at least one outer aperture 22 and locking pin 23 is located on the top potion 53 of either of the left or right posts, 51 and 52, respectively. Head support portion 18 comprises inner frame 25 having an inverted u-shape configuration forming a left and right inner post portion 56 and 57, respectively. Left and right inner post portions 56 and 57, respectively, further comprise a plurality of inner apertures 26, extending lengthwise along the left and right inner post portions, 56 and 57. Outer post insert aperture 55 is adapted to receive inner post portions 56 and 57 of inner frame 25 of head support portion 18. Each of the inner apertures 26 are located a distance from one another, ranging from 1 cm to 8 cm (0.4 inches to 3.14 inches), so that the head support portion 18 can be adjusted to a plethora of heights to accommodate persons of varying sizes. Inner frame 25 is adapted to be received in the hollow insert of outer frame 20. The inner frame 25 has a plurality of apertures 26 located at designated heights along the left and right inner post portions 56 and 57, respectively, of inner frame 25. Apertures 26 are adapted for receiving locking pin 23.

Outer aperture 22 is adapted to align with one of the plurality of apertures 26 of inner frame 25 as head support portion 18 is adjusted in an upward or downward direction. When the desired height of head support portion 18 is determined, outer aperture 22 and inner aperture 26 are aligned. Once aligned, locking pin 23 is inserted into outer aperture 22 and traverses into inner aperture 26 to lock head support portion 18 in place at the selected height. Phantom adjustment heights are indicated at 58, showing a sample of different heights available to head support portion 18 to readily accommodate patients of varying heights.

Head support portion 18 further comprises a horizontal cross bar 27 connecting the left and right inner post portions 56 and 57, respectively, of inner frame 25. Horizontal cross bar 27 may be provided with handles (not shown). Alternatively, head support portion 18 also includes a second cross bar 29. The horizontal cross bar 27 has adjustable support material 28 fixedly attached thereto. Head support portion 18 via the adjustment of inner frame 25, can be adjusted to various heights as indicated by way of phantom heights 58. As head support portion 18 is adjusted in height, adjustable support material 28 is contemporaneously adjusted in height. Adjustable support material 28 has a width of at least 15 cm (6 inches) in order to accommodate the back width of an average adult person. Adjustable support material 28 traverses behind cloth backing 21 of outer frame 20 as the adjustable support material 28 is fed from material roller system 24.

Adjustable support material 28 is part of material roller system 24. Material roller system 24 comprises adjustable support material 28 extending there from and rolled up thereon, a material roll bar 60, an inner roll rod 61, and a rolling pin system 62 providing adaptation of the material roller rod 60 and visa vie material roll bar 60 from a rolling position to and from a locking position. The rolling pin system 62 operates and functions as a typical window blind system. In other words, when a force is applied by pulling the adjustable support material 28 by way of adjusting head support portion 18 upward, the inner roll rod 61 and material roll bar 60 rotate in a feed direction, feeding out more adjustable support material 28, and visa vie the adjustable support material 28 extends or lengthens in an upward direction. In contrast, when the adjustable support material 28 by way of adjusting head support portion 18, is quickly pulled again, the inner roll rod 61 and material roll bar 60 rotate in the opposite retraction direction, causing the material roll bar 60 to retract or pull material onto the material roll bar 60, and visa vie the adjustable support material 28 retracts in a downward direction.

The rolling pin system 62 is activated to extend or retract the adjustable support material 28 when locking pin 23 is released from inner aperture 26 of inner frame 18 and outer aperture 22 of outer frame 17. Alternatively, the rolling pin system 62 is activated to extend or retract the adjustable support material 28 when directional force is applied to the head support portion 18 by applying a quick force causing rotation of the rolling pin system 62 in one direction, followed by another quick force causing rotation in the opposing direction. Second cross bar 29 is optional, and includes handles 31.

Having thus described the invention in rather full detail, it will be understood that such detail need not be strictly adhered to but that various changes and modifications may suggest themselves to one skilled in the art, all falling within the scope of the invention as defined by the subjoined claims.

What is claimed is:

1. An adjustable patient transport system for transporting a patient, comprising:

a) a patient transport chair having a seat portion, back portion, head support portion, rear leg portion, front leg portion, and material roller system;

b) said back portion comprising an outer frame having a hollow insert and a cloth backing adapted to support a patient's back, said outer frame further comprising an outer aperture for receiving a locking pin;

c) said head support portion comprising an inner frame being adapted to be received in said hollow insert of said outer frame of said back support portion, said inner frame having a plurality of apertures adapted for receiving said locking pin;

d) said head support portion further comprising a horizontal cross bar having adjustable support material fixedly attached thereto; and e) said material roller system comprising a material roll bar, an inner roll rod, and a rolling pin system adapted to activate said inner roll rod and material roll bar in a material feed position, material retraction position, or a locking position.

2. An adjustable patient transport system as recited by claim 1, wherein said material feed position of said rolling pin system is activated when said locking pin is released from said inner aperture of said inner frame and said inner frame is adjusted in an upward direction, said material retraction position being activated when said head support portion is quickly pulled once in a short upward motion, said locking position being activated when said head support portion is quickly pulled again in a short upward motion.

3. An adjustable patient transport system as recited by claim 1, wherein said front leg portion comprise two parallel bars and a horizontal bottom bar extending there between.

4. An adjustable patient transport system as recited by claim 3, comprising dual rotating carrying handles pivotally connected to each of said parallel bars of said front legs, said carrying handles each having a curved notch for receiving said bottom bar of said front leg portion when said rotating carrying handles are rotated in an extended position.

5. An adjustable patient transport system as recited by claim 1, wherein said head support portion further comprises a second cross bar having handles fixed thereto.

6. An adjustable patient transport system as recited by claim 1, wherein said rear leg portion further comprises dual omni-directional wheels composed of rubber.

7. An adjustable patient transport system as recited by claim 6, wherein said dual omni-directional wheels have a height ranging from 7 cm to 18 cm (2.8 to 7.09 inches).

8. An adjustable patient transport system as recited by claim 6, wherein said dual omni-directional wheels have a width ranging from 5 cm to 15.2 cm (2 to 6 inches).

9. An adjustable patient transport system as recited by claim 6, wherein said dual omni-directional wheels comprise an inner air tube surrounded by an outer rubber tire portion.

10. An adjustable patient transport system as recited by claim 1, wherein said front leg portion further comprises dual omni-directional wheels composed of rubber.

11. An adjustable patient transport system as recited by claim 1, wherein said seat portion and said back portion are pivotally connected by a first hinge, said back portion being adapted to rotate about said first hinge so that said back portion forms a flat configuration horizontal with said seat portion.

12. An adjustable patient transport system as recited by claim 1, wherein said front leg portion is pivotally connected by a second hinge to said seat portion, said front leg portion being adapted to rotate about said second hinge so that said front leg portion forms a flat configuration horizontal with said seat portion.

13. An adjustable patient transport system as recited by claim 1, wherein said rear leg portion is pivotally connected to said seat portion by way of a rear leg hinge, said rear leg portion being adapted to rotate about said rear leg hinge so that said rear leg portion folds under said seat portion.

14. An adjustable chair for transporting a patient as recited by claim 1, wherein said adjustable support material has a width of at least 15 cm (6 inches).

15. An adjustable chair for transporting a patient as recited by claim 1, wherein said chair can be folded up for storage.

* * * * *